US009290953B2

(12) United States Patent
Grimm et al.

(10) Patent No.: US 9,290,953 B2
(45) Date of Patent: Mar. 22, 2016

(54) COMPOUND CONTAINER

(71) Applicant: WARNER MANUFACTURING COMPANY, Minneapolis, MN (US)

(72) Inventors: Thomas M. Grimm, Woodbury, MN (US); David Henke, Maple Grove, MN (US)

(73) Assignee: Warner Manufacturing Company, Minneapolis, MN (US)

( * ) Notice: Subject to any disclaimer, the term of this patent is extended or adjusted under 35 U.S.C. 154(b) by 0 days.

(21) Appl. No.: 14/093,890

(22) Filed: Dec. 2, 2013

(65) Prior Publication Data

US 2014/0151249 A1 Jun. 5, 2014

Related U.S. Application Data

(60) Provisional application No. 61/731,851, filed on Nov. 30, 2012.

(51) Int. Cl.
*E04F 21/02* (2006.01)
*E04G 21/00* (2006.01)

(52) U.S. Cl.
CPC ..... *E04F 21/02* (2013.01); *E04G 21/00* (2013.01)

(58) Field of Classification Search
CPC ..... E04F 21/00; E04F 21/02; E04G 21/00
USPC ..... 220/755, 756, 757, 759, 669, 628, 633; 294/23.5; 224/219, 221, 267; 206/229; 248/688, 121, 127
See application file for complete search history.

(56) References Cited

U.S. PATENT DOCUMENTS

| | | | | |
|---|---|---|---|---|
| 5,183,280 | A * | 2/1993 | Gresch | 280/79.5 |
| 5,257,695 | A * | 11/1993 | Henke et al. | 206/373 |
| 6,454,124 | B1 | 9/2002 | Edwards et al. | |
| 6,923,485 | B1 * | 8/2005 | Bauswell | 294/3.5 |
| 7,469,809 | B2 * | 12/2008 | Rodarte et al. | 224/578 |
| 7,845,656 | B2 * | 12/2010 | Thompson | 280/79.5 |
| 7,988,012 | B2 * | 8/2011 | Bruno et al. | 220/695 |
| 8,556,116 | B2 | 10/2013 | Bergman et al. | |
| 8,567,832 | B2 * | 10/2013 | Kannaka | 294/25 |
| 2003/0159966 | A1 * | 8/2003 | McMichael et al. | 206/570 |
| 2006/0273086 | A1 * | 12/2006 | Marino et al. | 220/62.1 |

* cited by examiner

*Primary Examiner* — Steven A. Reynolds
*Assistant Examiner* — Javier A Pagan
(74) *Attorney, Agent, or Firm* — Hamre, Schumann, Mueller & Larson, P.C.

(57) ABSTRACT

A compound container includes a container body having a side wall and a bottom wall; an interior space defined by the side wall and the end wall; an opening defined by an upper edge of the side wall; and an elongated hand support member having a first attachment section and a second attachment section for attaching the hand support member to a bottom surface of the bottom wall. The hand support member is positioned generally parallel to the opening defined by the upper edge of the side wall.

20 Claims, 9 Drawing Sheets

COMPOUND CONTAINER

FIELD

The embodiments hereby disclosed relate generally to drywall tools, and more specifically to hand-held compound containers used to hold compound in drywall construction.

BACKGROUND

Compound containers, also known as mud pans, are available in various sizes, and are used to provide workers with easy access to the compound necessary for drywall construction projects. Workers generally carry a compound container in one hand, and a taping knife in the other. In this way, a worker can use the knife both to remove compound from the container and to mix the compound as necessary.

SUMMARY

Some embodiments of a compound container can be constructed to include a hand support member attached to a bottom of the compound container, allowing a user's hand to be extended between the hand support member and the bottom of the compound container and thereby enhancing a holding of the compound container by the user's hand. For example, the hand support member can be an expandable hand support member. When not in use, the hand support member is in a relaxed configuration without being under tension. When in use, the user's hand is extended between the hand support member and the bottom of the container body, and the hand support member can be stretched to an expanded configuration, applying an elastic force on the user's hand and thereby enhancing a holding of the compound container by the user's hand. It is to be understood that the hand support member can be made of materials other than elastic material. In such configuration, the hand support member can include buttons to allow the length of the hand support member to be adjusted to secure the user's hand to the bottom of the container body.

Moreover, the compound container can be constructed with a tool holder including a friction holding tab for holding a taping knife. The friction holding tab can be formed as a part of a side stand located at an end of the compound container such that the taping knife can be secured at the end of the compound container when not in use.

Moreover, the compound container can be constructed with two side stands, allowing the compound container to stand on a flat surface regardless whether the container body has a flat bottom or rounded bottom. The side stands can be spaced away from the bottom of the container body, allowing the compound container to be stackable for economical point of purchase display.

Moreover, the compound container can be constructed with a rounded corner on one side of its bottom and an edged corner on the other side of its bottom. The rounded corner allows easy gripping of the bottom of the container body by the user's hand, while the edged corner allowing a blade of a taping knife to be maintained at the corner when the taping knife is placed inside a spaced defined by the container body.

In particular embodiments, a compound container includes a container body having a side wall and a bottom wall, an interior space defined by the side wall and the end wall, an opening defined by an upper edge of the side wall; and an elongated hand support member having a first attachment section and a second attachment section for attaching the hand support member to a bottom surface of the bottom wall.

The hand support member is positioned generally parallel to the opening defined by the upper edge of the side wall.

In some embodiments, a compound container kit includes a container body having a side wall and a bottom wall; an interior space defined by the side wall and the end wall; an opening defined by an upper edge of the side wall; an elongated hand support member having a first attachment section and a second attachment section for attaching the hand support member to a bottom surface of the bottom wall; and instructions for attaching the hand support member to the bottom surface of the bottom wall. The bottom wall is configured generally parallel to the opening defined by the upper edge of the side wall.

Other embodiments may include a method of using a compound container. The compound container in the method includes a container body having a side wall and a bottom wall; an opening defined by an upper edge of the side wall; and an elongated hand support member having a first attachment section and a second attachment section for attaching the hand support member to a bottom surface of the bottom wall. The method includes extending extend a hand between the hand support member and the bottom surface of the bottom wall; and holding on an outer surface of the side wall to manipulate the orientation of the compound container.

The details of one or more embodiments of the invention are set forth in the accompanying drawings and the description below. Other features, objects and advantages of the invention will be apparent from the description and drawings, and from the claims.

BRIEF DESCRIPTION OF THE DRAWINGS

The following is a brief explanation of embodiments herein using drawings and embodiments.

DETAILED DESCRIPTION

Embodiments disclosed herein relate to a compound container including an elongated body and a hand support member. The elongated body has an opening, two long edge sides opposing each other, two short edge sides opposing each other, and a bottom. The elongated body of the compound container may have a flat rectangular bottom with two edged corners along the long edges, or it may have a rounded bottom with an edge corner and a rounded corner along the long edges, or it may have a rounded bottom with two rounded corners along the long edges. The hand support member is attachable to the bottom of the compound container, allowing a user's hand to extend between the hand support member and the bottom of the compound container, and thereby enhancing the holding of the compound container by the user's hand. The length of the hand support member can be adjustable.

Figure 1:
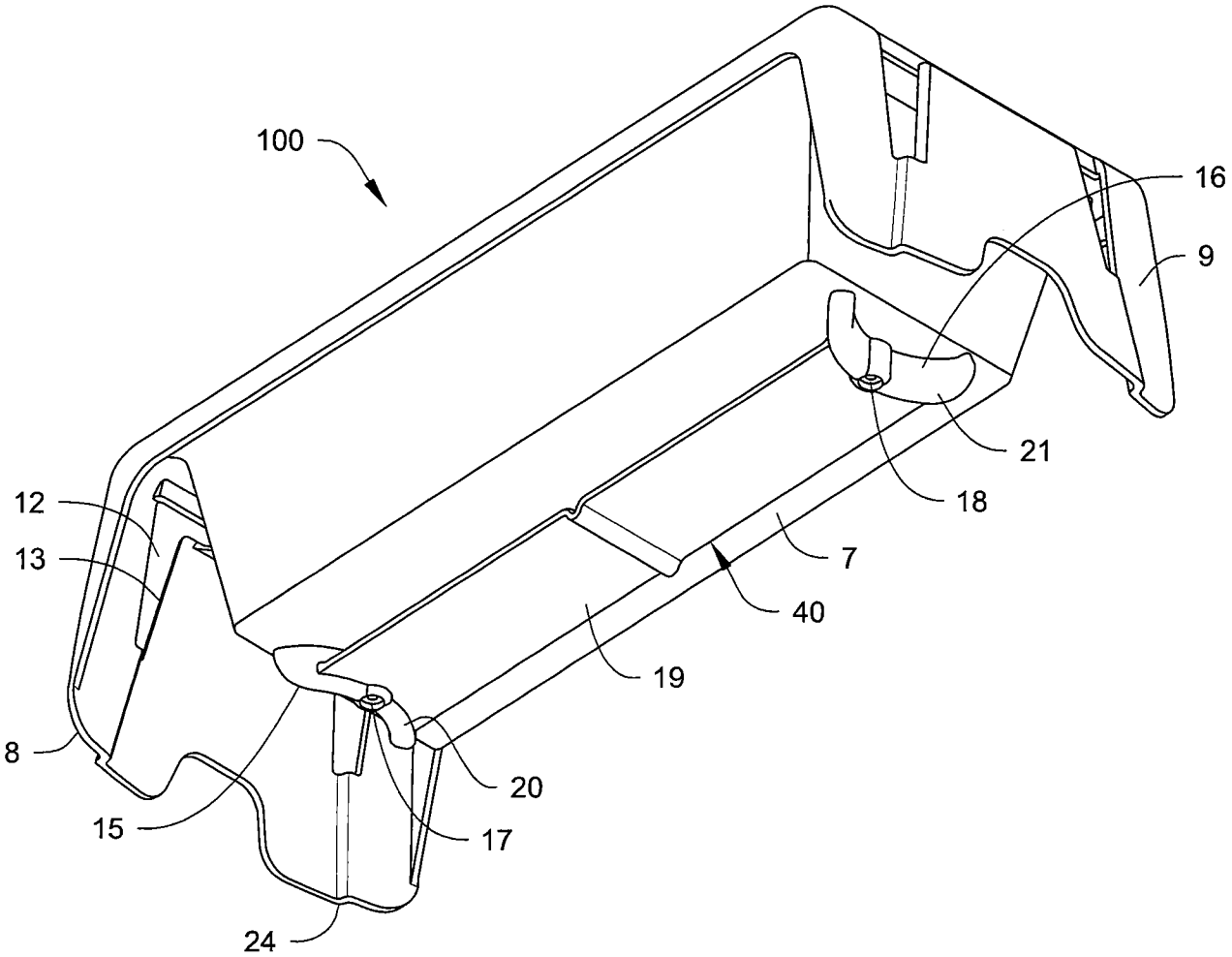
FIG. 1 is a bottom perspective view of a compound container with an edged bottom design with a hand support member of FIG. 4 attached.
Figure 2:
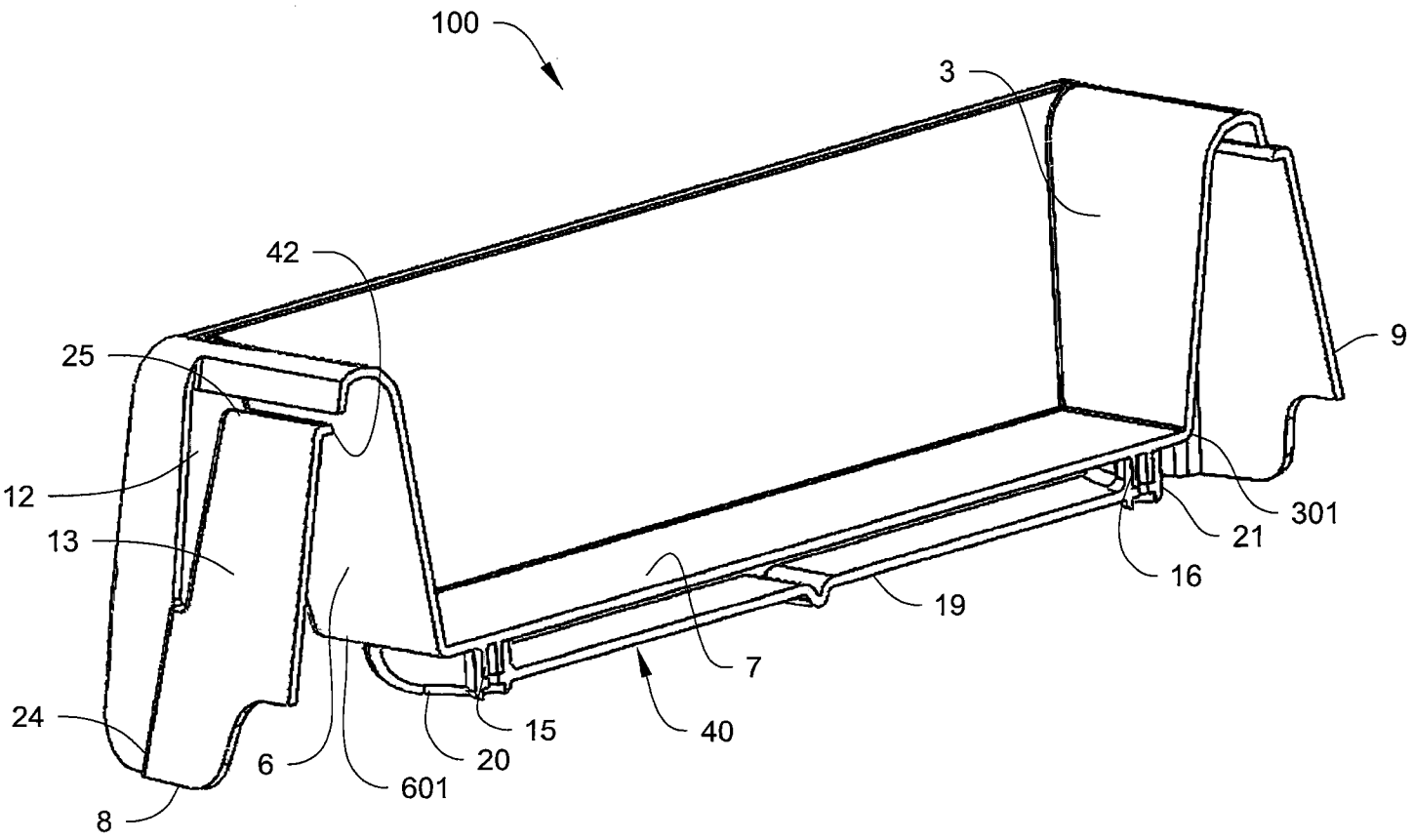
FIG. 2 is a sectional view of the compound container of FIG. 1.
Figure 3:
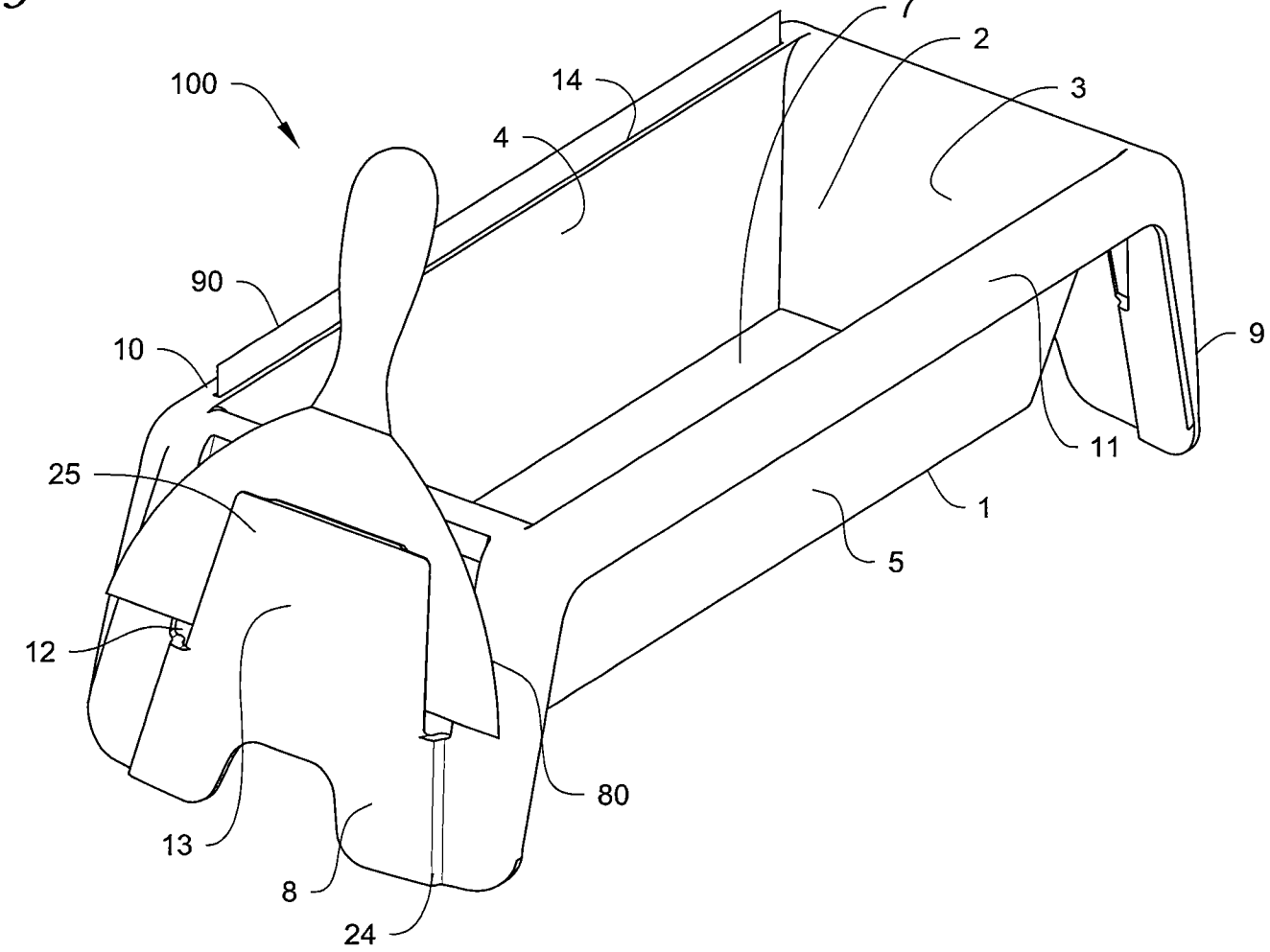
FIG. 3 is a perspective view of the compound container of FIG. 1.
Figure 7:
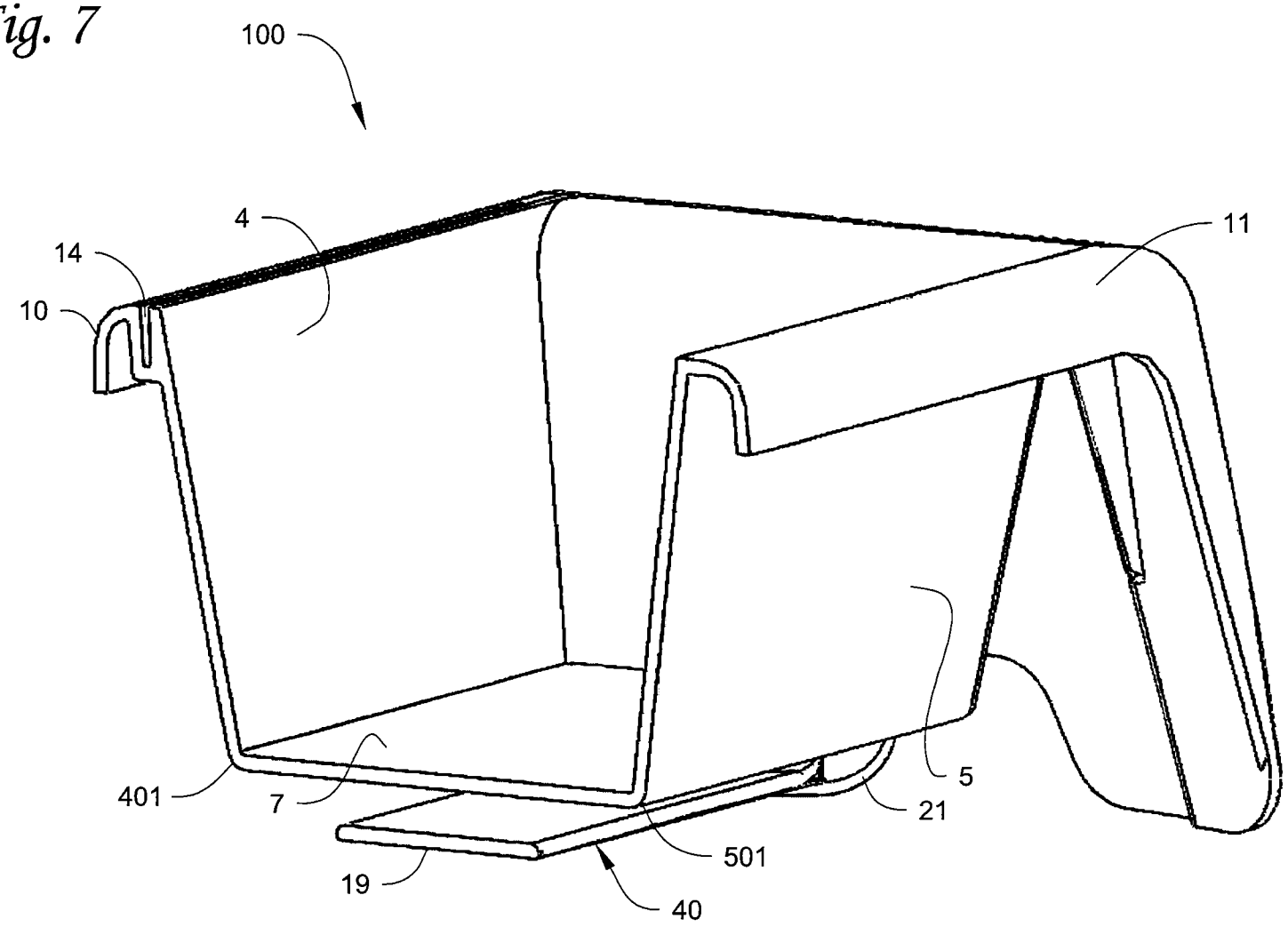
FIG. 7 is a further sectional view of the compound container of FIG. 1.

As shown in FIGS. 1-3, a compound container 100 includes an elongated body 1 (referring to FIG. 3) used to hold drywall compound. The elongated body includes an opening 2 (referring to FIG. 3), two long edge sides 4, 5 opposing each other, two short edge sides 3, 6 opposing each other, and a bottom 7. The opening 2 and the bottom 7 are both defined by the long edge sides 4, 5 and the short edge sides 3, 6. The opening 2 may be in a rectangular shape. The bottom 7 may be flat in a rectangular shape. An area of the bottom 7 may be smaller than an area defined by the periphery of the opening 2. As shown in FIG. 7, the long edge sides 4, 5 may be inwardly inclined when extending toward the bottom 7, forming two edged corners 401, 501. As shown in FIG. 2, the short edge sides 3, 6 may be straight, inwardly inclined when extending toward the bottom 7, forming two edged corners. A compound container with a flat, rectangular bottom may be more stable when placed on a flat surface.

Figure 6:
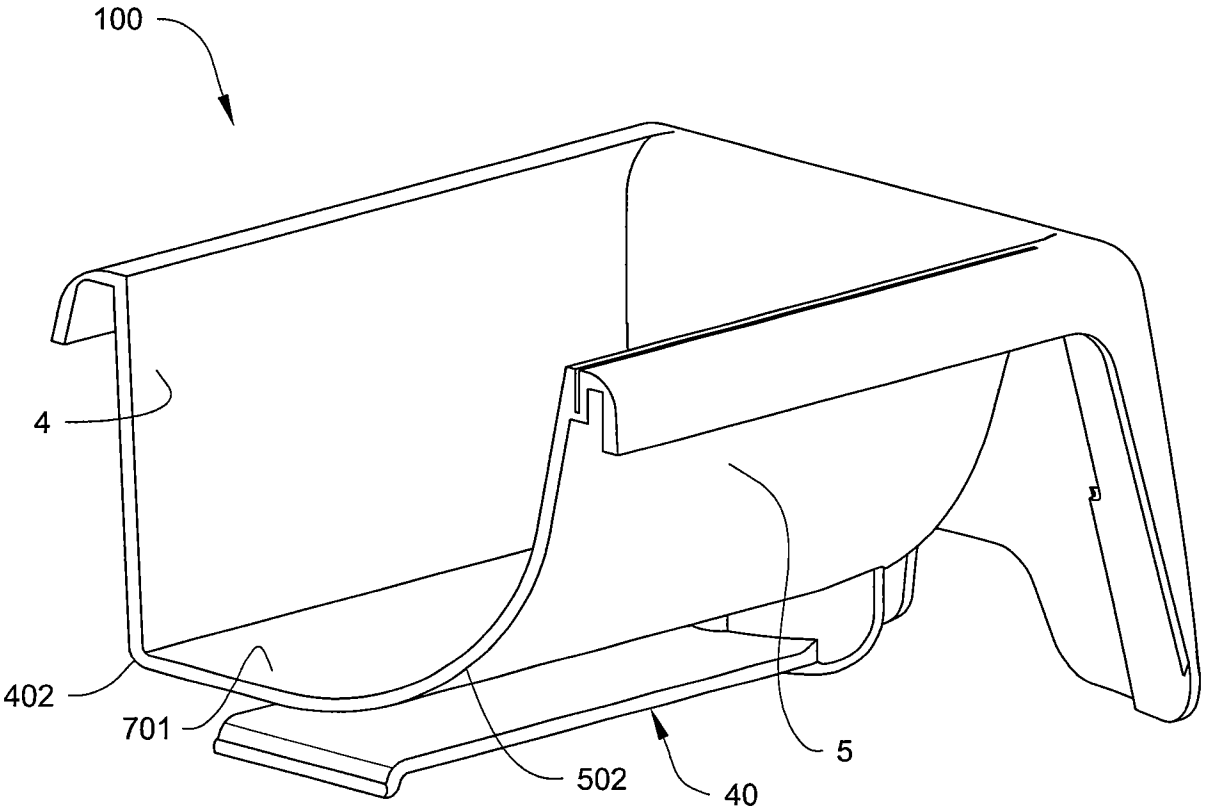
FIG. 6 is a sectional view of a compound container with a rounded bottom design on one of the two long edges with the hand support member of FIG. 4 attached.

Alternatively, in another embodiment as shown in FIG. 6, a rounded bottom design may be used. A rounded bottom 701 has an edged corner 402 and a rounded corner 502 connecting to the long edge sides 4, 5 respectively along the long edges of the rounded bottom 701. The rounded corner 502 allows the elongated body 1 to have a more ergonomic design with more grips. Thus one may hold the compound container more easily and more comfortably for an extend period of time. In the meantime, the edged corner 402 allows a paint tool, such as a taping knife blade, to stay at the edged corner 402. At the same time the rounded bottom may allow a taping knife blade to be placed along the long edge side 4 connected with the edged corner 402 without flipping over when in use.

Figure 8:
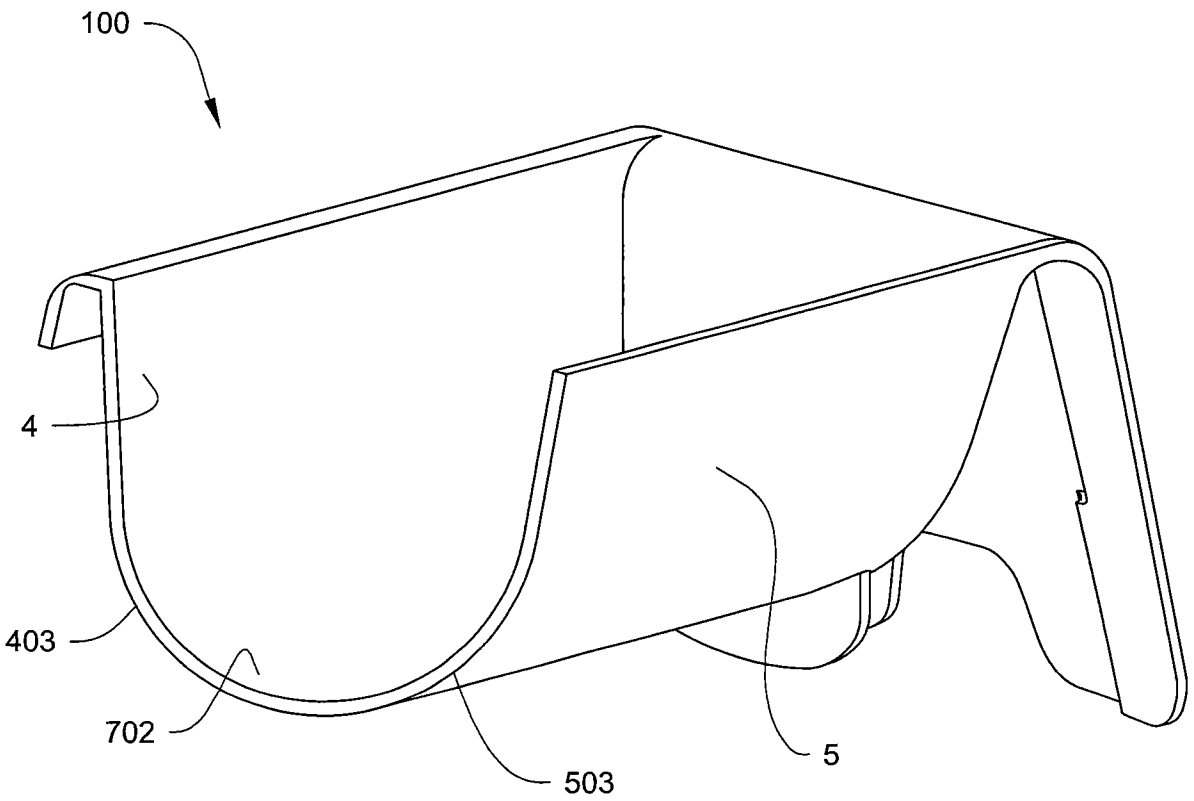
FIG. 8 is a sectional view of a compound container with a rounded bottom design on both of the two long edges without a hand support member attached.

Yet in another embodiment as shown in FIG. 8, the elongated body 1 may have a rounded bottom 702. The rounded bottom 702 has two rounded corners 403, 503 connecting to the long edge sides 4, 5 along the long edges of the rounded bottom 702, providing more grips and comfort when one is holding the compound container.

Figure 5:
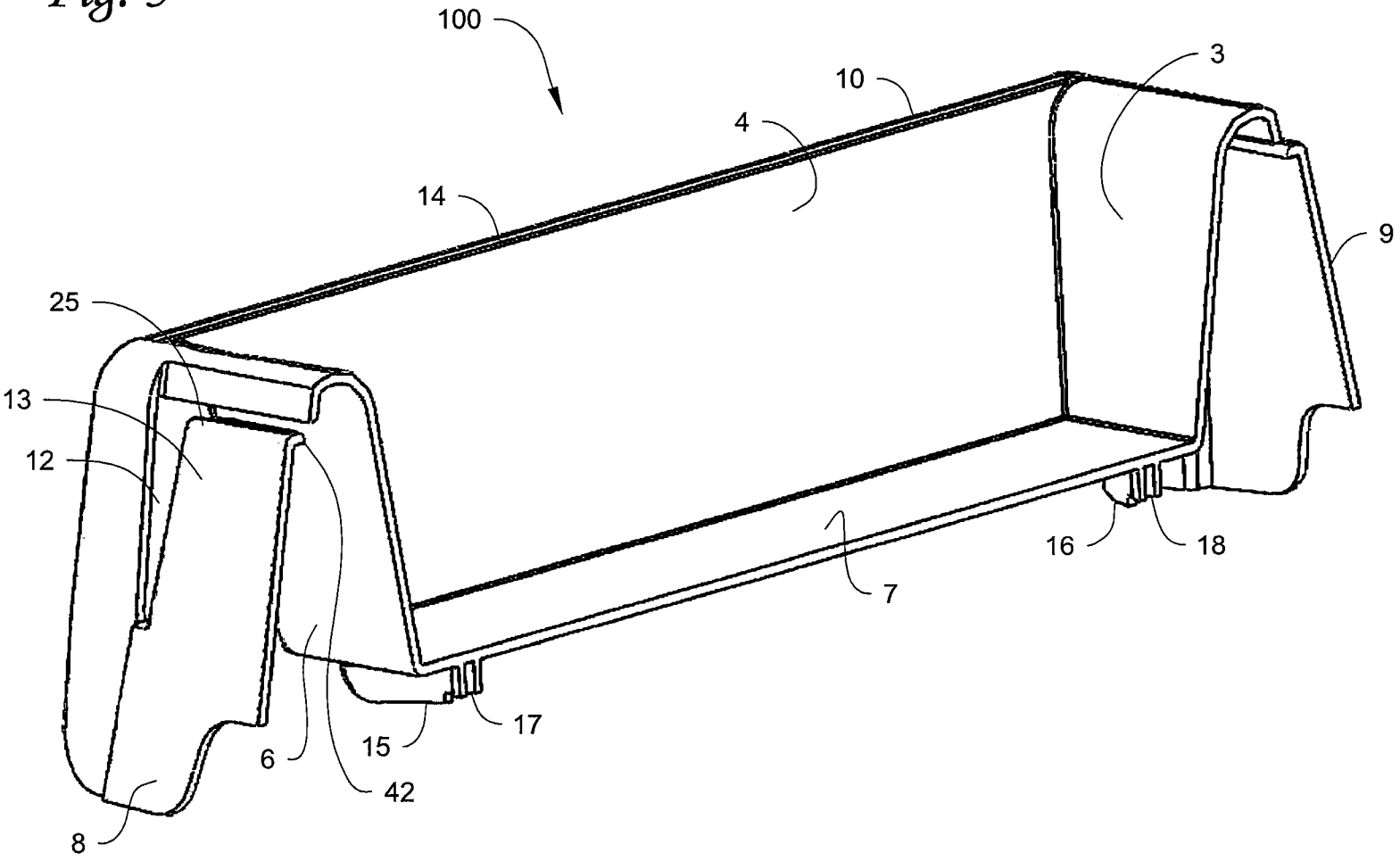
FIG. 5 is a sectional view of the compound container of FIG. 1 without a hand support member attached.

As shown in FIG. 5, two holding members 15, 16 are placed on the bottom surface of the bottom 7, in generally parallel with each other along two short edges 301, 601 of the bottom 7 and near the two short edges 301, 601 of the bottom 7 respectively. The holding members 15, 16 allow a hand support member 40 to be attached to the bottom 7 of the compound container 100.

In an embodiment as shown in FIG. 1, the holding members 15, 16 may be in a curved shape, curving away from the short edges 301, 601 of the bottom 7. The curved design allows more connection space with a hand support member 40, while avoiding the hand support member 40 intruding out of the short edges 301, 601 of the bottom 7 and adversely affecting the stackability of the compound container. Two retaining members 17, 18 may be placed in the center of each of the holding members 15, 16, in order to further secure the hand support member 40 using screws. It is understood that other fastening meanings may be utilized to secure the hand support member.

Figure 4:
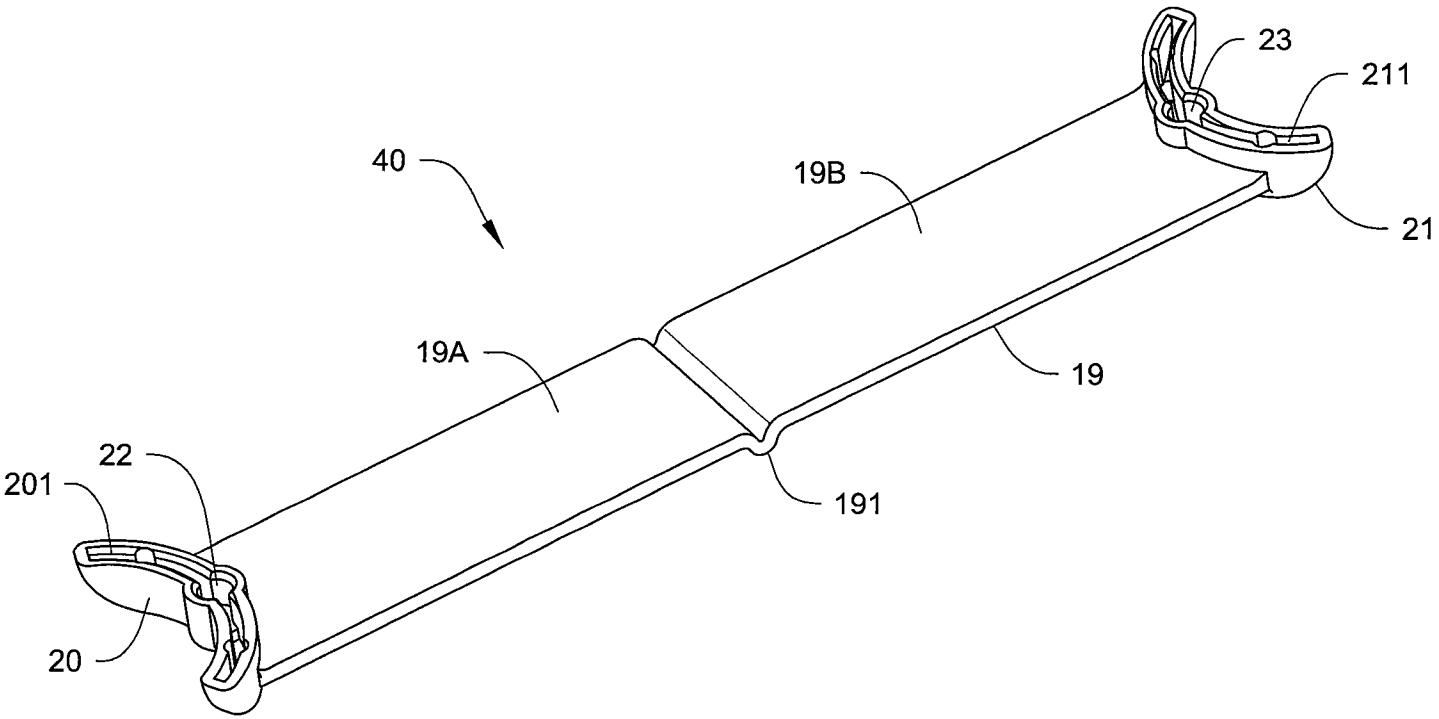
FIG. 4 is a perspective view of a hand support member attachable to a compound container.

FIG. 4 shows a hand support member 40 including an elongate body 19. It is to be understood that the hand support member 40 can be configured in various configurations, as long as it has an elongate body and can be used to support the back of the user's hand when the hand holds on long edge sides 4, 5 or bottom 7 of the compound container 100. The hand support member 40 can have a strap shape or a string shape, and in some embodiments, a plurality hand support members 40 can be attached to the bottom surface of the bottom 7 of the compound container 100.

The hand support member 40 may also include two holding members 20, 21 to both ends of the hand support member 40 engageable with the corresponding holding members 15, 16. The holding members 20, 21 may be curved away from the short edges 301, 601 of the bottom 7. The curved design allows more connection space with the body 1, while avoiding the hand support member 40 intruding out of the short edges 301, 601 of the bottom 7 and adversely affecting the stackability of the compound container. Each of the holding members 20, 21 may have a cavity 201, 211, respectively, in a shape which tightly fits the above disclosed holding members 15, 16 respectively, allowing the holding members 20, 21 to be able to be plugged in and fixed securely. Two retaining members 22, 23 may be placed in the center of each of the holding members 20, 21, further securing the hand support member 40 on to the bottom 7 using screws. The elongate body 19 has an expansion rib 191 in the center of the elongate body 19. The expansion rib 191 may use stretchable materials, connecting the two body pieces 19A, 19B together. When a hand is placed between the bottom 7 and the elongate body 19, the two body pieces 19A, 19B may bend outwardly, and the expansion rib 191 may be stretched. Thus the expansion rib 191 allows the length of the elongate body 19 to be adjustable to the size of one's hand holding the compound container. In another embodiment, the elongate body may include buttons and buttonholes allowing the length of the elongate body 19 to be adjustable. It is to be understood that the length of the elongate body 19 can be adjusted by other means as long as the intended function is attained.

As shown in FIGS. 1 and 2, the hand support member 40 is attached to the bottom surface of the bottom 7 of the compound container 100. When the hand support member 40 is attached to the bottom surface of the bottom 7 of the compound container 100, the two holding members 20, 21 tightly hold the two holding members 15, 16. To further secure the attachment between the hand support member 40 and the compound container 100, screws may be placed through the retaining members 17, 18 of the holding members 15, 16 and the retaining members 22, 23 of the holding members 20 or 21.

When the hand support member 40 is attached to the compound container 100, the ends of the two holding members 20, 21 are in a position not extending beyond the two short edges 301, 601 of the bottom 7 respectively, such that the total length of the hand support member 40 including the two holding members 20, 21 is no longer than the length of the long edge of the bottom 7, allowing the compound containers stackable while the hand support members are attached.

As further shown in FIG. 7, when the hand support member 40 is attached to the bottom surface of the bottom 7, a distance between the elongate body 19 and the bottom surface of the bottom 7 of the compound container 100 is large enough for holding the compound container 100 comfortably using the hand support member 40; however the length added to the bottom surface of the bottom 7 by attaching the hand support member 40 is within a range of distance within which the stackability of the compound containers is not affected by attaching the hand support member 40.

In another embodiment as shown in FIGS. 1 to 3, the compound container 100 may also include two side stands 8, 9 extending from two opposing edges of the opening 2. The vertical length of the side stands 8, 9 may be longer than the vertical length from the edges of the opening 2 to the lowest point of the hand support member 40 when the hand support member 40 is attached to the compound container 100, allowing the side stands 8, 9 to support the elongated body 1 even when the hand support member 40 is attached. The side stands 8, 9 may have a leg design to reduce material used for manufacturing and to help keep the compound container 100 in balance when placed on a flat surface.

Still referring to FIGS. 1-3, in one embodiment, the side stands 8, 9 may be outwardly inclined when extending toward the bottom 7, forming an angle relative to the vertical direction. One side stand 8 has a tool holder including a blade slot 12 with a friction holding tab 13, allowing a taping knife blade 80 to be placed in the blade slot 12 and held tightly when the taping knife is not in use. The friction holding tab 13 is carved out from a convex 24 bulging slightly out of the plane of the side stand 8, and the top part of the friction holding tab 13 includes a tongue 25 having a free edge 42 extending inwardly toward the elongated body 1 generally parallel to the horizontal surface plane of the compound container 100. The tongue 25 provides more friction when the taping knife blade 80 is placed into the blade slot 12. It is to be understood that the blade slot 12 may be placed in either one of, or both of the side stands 8, 9.

In another embodiment as shown in FIGS. 3 and 7, the compound container 100 may further include two lips 10, 11 extending outwardly from the two long edge sides 4, 5 of the opening 2. The lips 10, 11 may extend from the two opposing long edges of the opening 2, and further curl downwardly so that there are no sharp edges formed along the periphery of the opening 2 and thus the hands of one who is using the compound container may be protected from being cut. Curled lips may also add strength and stiffness to the long edge sides 4, 5. One of the lips 10, 11 may have a scraping blade slot 14. The scraping blade slot 14 may have a narrow and deep vertical opening, the width and length of which may be large enough to allow a scraping blade 90 to be placed in the scraping blade slot 14 and to stay stably therein. It is to be understood that the scraping blade slot 14 may be placed in either one of, or both of the lips 10, 11. In such circumstances, the compound container 100 further includes the one or more scraping blades 90 placed in the scraping blade slot(s) 14. In some embodiments, the scraping blades 90 can be removed for cleaning after use of the compound container 100.

Figure 9:
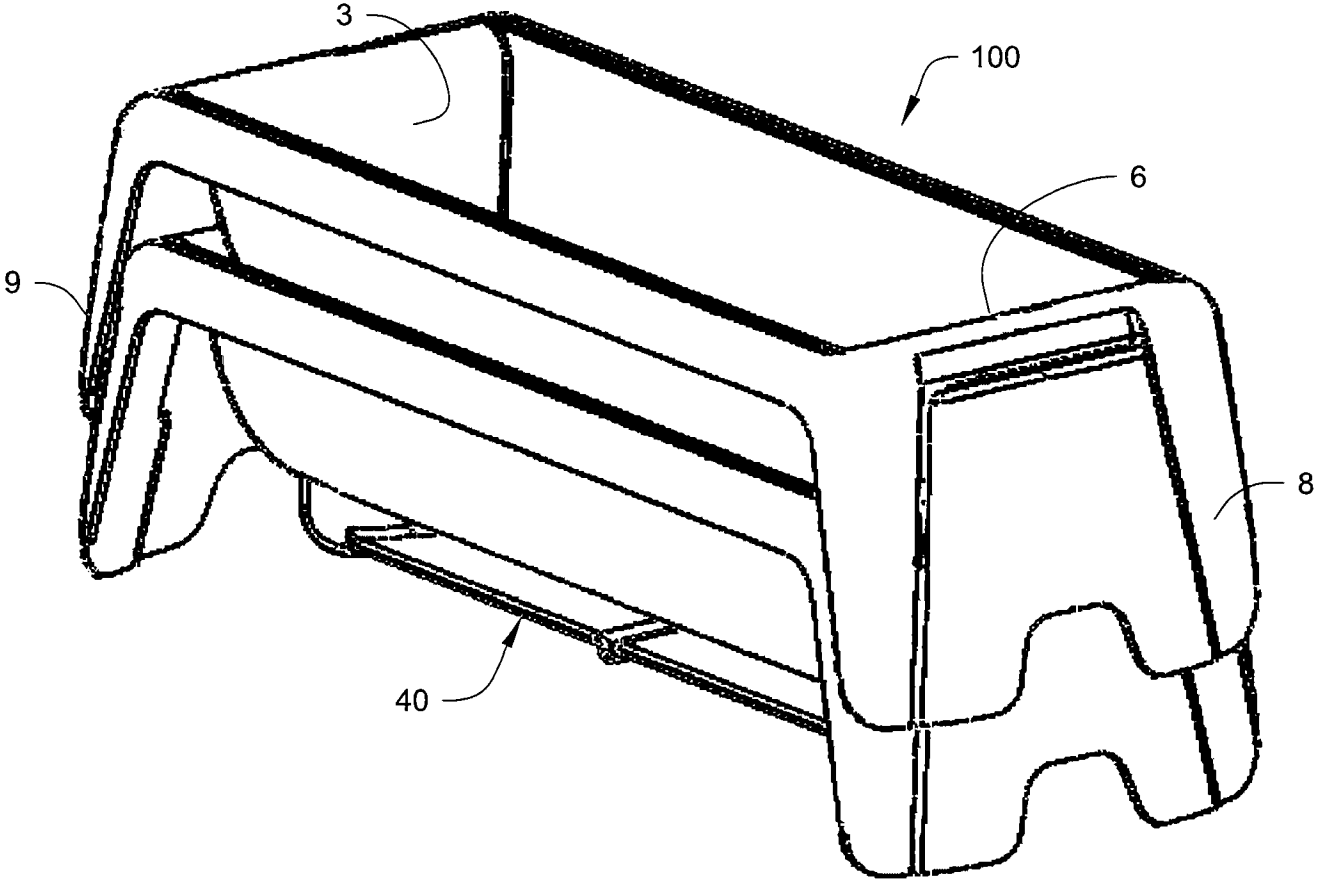
FIG. 9 is a perspective view of two compound containers of FIG. 1 stacked together.

As shown in FIG. 9, two compound containers each with a hand support member attached are stacked together by placing one compound container on top of another. When stacked together, the short edge sides 3, 6 of the compound container 100 placed atop cling firmly to the short edge sides of the compound container placed underneath, allowing sufficient friction so that during movement stacked compound containers remain firmly stacked without being unintentionally separated. The side stands 8, 9 and the short edge sides 3, 6 close to the side stands 8, 9 respectively may connect with each other at the short edge of the opening 2 in an acute angle. When two compound containers are stacked together, the side stands 9, 8 of the compound container in below are placed underneath the side stands 3, 6 of the compound container 100 on top; the side stands 8, 9 in below are pressed and slightly bent inwardly, producing more friction between the compound containers when stacked together. The elongated body 1 of the compound container 100 including the holding members 15, 16 may be molded using one or multiple embodiments herein disclosed. Elastroplastic with sufficient strength and durability, or other material with equivalent characteristics may be used for the elongated body 1 including the holding members 15, 16, and for the holding members 20, 21 of the hand support member 40. Soft materials like vinyl or thermal plastic elastomer may be used for the elongate body 19 of the hand support member 40.

The above are merely preferred embodiments of this application, and it is understood that by a person skilled in this art, several alternations and improvements are still considered within the scope of this application so long as they do not differ from the structure in this application. Such alternations and improvements shall not affect the practicability and utility of this application.

The invention claimed is:

1. A compound container, comprising:

a container body having first and second end walls, first and second side walls extending along a longitudinal direction of the container body between the first and second end walls, and a bottom wall closing a bottom opening defined by the first and second end walls and the first and second side walls, the bottom wall having a width defined between the first and second side walls, a first corner being formed between the first side wall and the bottom wall, and a second corner being formed between the second side wall and the bottom wall;

an interior space defined by the first and second end walls, the first and second side walls and the bottom wall;

an opening defined by upper edges of the first and second side walls and the first and second end walls;

an elongated hand support member extending in the longitudinal direction of the container body and attached to a bottom surface of the bottom wall; and two opposing stands located only at the first and second end walls of the container body, respectively and not at the side walls, the two opposing stands being sized to raise the bottom wall of the container body above a support surface on which the compound container is placed, and space the bottom wall away from the support surface, wherein the hand support member is positioned generally parallel to the opening defined by the upper edge of the side, and wherein the hand support member is positioned to allow a user's hand to extend between the hand support member and the bottom surface of the bottom wall, from a side close to the first side wall across the width of the bottom wall to a side close to the second side wall, thereby allowing the user's hand to wrap around the first and second corners and hold on outer surfaces of the first and second side walls to manipulate the orientation of the compound container.

2. The compound container of claim 1, wherein the hand support member is made of an elastic material.

3. The compound container of claim 1, wherein the hand support member includes an expansion rib.

4. The compound container of claim 1, wherein each of the stands includes a tool holder configured for holding a hand tool.

5. The compound container of claim 4, wherein the tool holder has a friction holding tab, a top of the friction holding tab having a tongue extending toward the container body.

6. The compound container of claim 3, wherein the first and second end walls are positioned generally opposite to each other, and the first and second side walls are positioned generally opposite to each other.

7. The compound container of claim 6, wherein the first corner is a rounded corner; and the second corner is an edged corner.

8. The compound container of claim 6, wherein the first corner is an edged corner; and the second corner is an edged corner.

9. The compound container of claim 6,
wherein the first corner is a rounded corner; and
the second corner is a rounded corner.

10. The compound container of claim 6, wherein at least one of the side walls has a lip extending outwardly from a top edge of the respective side wall, the lip having a scraping blade slot for receiving a scraping blade.

11. The compound container of claim 10, further comprising a removable scraping blade disposed in the scraping blade slot.

12. The compound container of claim 1, wherein when the compound container is stacked with another compound container, the bottom wall, the hand support member, and at least a portion of the side walls are received in an interior space defined by side walls and a bottom wall of a container body of the other container.

13. The compound container of claim 1, wherein the hand support member is positioned generally parallel to the bottom wall of the container body.

14. The compound container of claim 1, wherein the hand support member is secured to the bottom wall of the container body; the bottom wall of the container body being configured to meet the side walls and the end walls at edges of the bottom wall, when viewed from above the bottom wall, the hand support member does not extend outside the edges of the bottom wall.

15. The compound container of claim 1, wherein the hand support member is secured to the bottom wall by screws.

16. The compound container of claim 1, wherein the hand support member has two ends and an elongated body extending between the two ends, two curved holding members being formed at the two ends of the hand support member, respectively; when the hand support member is attached to the bottom surface of the bottom wall of the container body, each of the holding members being positioned to curved toward a respective short edge of the bottom wall of the container body.

17. A method of using a compound container of claim 1, comprising:

extending a hand between the hand support member and the bottom surface of the bottom wall from a side close to the first side wall across the width of the bottom wall to a side close to the second side wall, thereby allowing the user's hand to wrap around the first and second corners; and holding on outer surfaces of the side walls to manipulate the orientation of the compound container.

18. A compound container kit, comprising:

a container body having first and second end walls, first and second side walls extending along a longitudinal direction of the container body between the first and second end walls, and a bottom wall closing a bottom opening defined by the first and second end walls and the first and second side walls, the bottom wall having a width defined between the first and second side walls, a first corner being formed between the first side wall and the bottom wall, and a second corner being formed between the second side wall and the bottom wall;

an interior space defined by the first and second end walls, the first and second side walls and the bottom wall;

an opening defined by upper edges of the first and second side walls and the first and second end walls;

an elongated hand support member having a first attachment section and a second attachment section for attaching the hand support member to a bottom surface of the bottom wall along the longitudinal direction of the container body;

two opposing stands located only at the first and second end walls of the container body, respectively and not at the side walls, the two opposing stands being sized to raise the bottom wall of the container body above a support surface on which an assembled compound container is placed, and space the bottom wall away from the support surface; and instructions for attaching the hand support member to the bottom surface of the bottom wall, allowing the hand support member to be positioned generally parallel to the opening defined by the upper edge of the side wall, and instructions for use of the hand support member, allowing a user's hand to extend between the hand support member and the bottom surface of the bottom wall across the width of the bottom wall, from a side close to the first side wall across the width of the bottom wall to a side close to the second side wall, thereby allowing the user's hand to wrap around the first and second corners and hold on outer surfaces of the first and second side walls to manipulate the orientation of the compound container.

19. The compound container of claim 18, wherein the hand support member is made of an elastic material.

20. The compound container of claim 18,
wherein the first corner is a rounded corner; and
the second corner is an edged corner.

* * * * *